US009004344B2

(12) United States Patent
Smith

(10) Patent No.: US 9,004,344 B2
(45) Date of Patent: Apr. 14, 2015

(54) PAPERBOARD SECURITY PACKAGES

(75) Inventor: Alyssa Smith, Raleigh, NC (US)

(73) Assignee: MeadWestvaco Corporation, Richmond, VA (US)

( * ) Notice: Subject to any disclaimer, the term of this patent is extended or adjusted under 35 U.S.C. 154(b) by 680 days.

(21) Appl. No.: 12/797,745

(22) Filed: Jun. 10, 2010

(65) Prior Publication Data

US 2011/0024486 A1 Feb. 3, 2011

Related U.S. Application Data

(60) Provisional application No. 61/229,924, filed on Jul. 30, 2009.

(51) Int. Cl.

| | |
|---|---|
| ***B65D 5/08*** | (2006.01) |
| ***B65D 5/02*** | (2006.01) |
| ***B65D 5/42*** | (2006.01) |
| ***B65D 5/50*** | (2006.01) |

(52) U.S. Cl.

CPC ..... *B65D 5/0227* (2013.01); *B65D 5/0254* (2013.01); *B65D 5/0281* (2013.01); *B65D 5/4208* (2013.01); *B65D 5/5002* (2013.01); *B65D 2101/00* (2013.01)

(58) Field of Classification Search

CPC .... B65D 5/02; B65D 5/0227; B65D 2101/00; B65D 5/0254; B65D 5/10; B65D 5/2007

USPC ..... 229/132, 126, 198.2, 237, 102, 208, 229/148, 241, 134, 136; 493/151, 150

See application file for complete search history.

(56) References Cited

U.S. PATENT DOCUMENTS

| | | | | |
|---|---|---|---|---|
| 3,524,581 | A * | 8/1970 | Buttery | 229/226 |
| 3,893,614 | A | 7/1975 | Meyers | |
| 4,331,240 | A * | 5/1982 | Vanasse | 229/224 |
| 4,479,588 | A * | 10/1984 | Davis et al. | 229/102 |
| 4,506,789 | A | 3/1985 | Dlugosz | |
| 4,537,312 | A | 8/1985 | Intini | |
| 4,666,044 | A | 5/1987 | Farber | |
| 4,746,052 | A | 5/1988 | Schmissrauter | |
| 4,830,270 | A * | 5/1989 | Holmes | 229/102 |
| 4,919,271 | A | 4/1990 | Kuchenbecker | |
| 4,961,494 | A | 10/1990 | Alexander | |
| 5,044,503 | A | 9/1991 | Wein | |
| 5,088,603 | A | 2/1992 | Kirkpatrick | |
| 5,167,606 | A | 12/1992 | Kuchenbecker | |
| 5,172,812 | A | 12/1992 | Wharton et al. | |
| 5,325,968 | A | 7/1994 | Sowden | |
| 5,511,665 | A | 4/1996 | Dressel et al. | |

(Continued)

FOREIGN PATENT DOCUMENTS

| | | |
|---|---|---|
| EP | 0577866 A1 | 1/1994 |
| GB | 2367811A A1 | 4/2002 |

(Continued)

OTHER PUBLICATIONS

PCT/US2009/049536 International Search Report and IPRP, mailed Oct. 15, 2009 for another application.

(Continued)

*Primary Examiner* — Christopher Demeree

(57) ABSTRACT

Security packages are disclosed having features that give increased resistance against theft by preventing or slowing opening of the package.

12 Claims, 11 Drawing Sheets

(56) References Cited

U.S. PATENT DOCUMENTS

| | | | | |
|---|---|---|---|---|
| 5,605,278 | A * | 2/1997 | Jensen | 229/103.2 |
| 5,641,118 | A | 6/1997 | Benham | |
| 5,769,310 | A | 6/1998 | Benham | |
| 5,785,180 | A | 7/1998 | Dressel et al. | |
| 5,865,366 | A | 2/1999 | Benham | |
| 5,865,367 | A | 2/1999 | Benham | |
| 5,894,930 | A | 4/1999 | Faughey et al. | |
| 5,927,500 | A | 7/1999 | Godfrey et al. | |
| 5,944,191 | A | 8/1999 | Ray et al. | |
| 6,126,066 | A | 10/2000 | Peterson et al. | |
| 6,161,699 | A | 12/2000 | Gartland | |
| 6,237,839 | B1 | 5/2001 | Brown | |
| 6,273,260 | B1 | 8/2001 | Coldepietro et al. | |
| 6,338,407 | B2 | 1/2002 | Danville | |
| 6,394,275 | B1 | 5/2002 | Paliotta et al. | |
| 6,422,391 | B1 | 7/2002 | Swartz | |
| 6,705,467 | B1 | 3/2004 | Kancsar et al. | |
| 6,974,032 | B2 | 12/2005 | Intini | |
| 7,448,496 | B2 | 11/2008 | Williams-Hartman | |
| 2002/0100709 | A1 | 8/2002 | Shibata | |
| 2004/0183643 | A1 | 9/2004 | Brunner | |
| 2005/0145683 | A1 | 7/2005 | Alagna et al. | |
| 2006/0071057 | A1 | 4/2006 | Aschenbrenner et al. | |
| 2007/0114153 | A1 | 5/2007 | Ritter | |
| 2007/0114154 | A1 | 5/2007 | Ritter | |

FOREIGN PATENT DOCUMENTS

| | | | |
|---|---|---|---|
| WO | WO9501623A1 | A1 | 1/1995 |
| WO | WO2007022903 | A1 | 3/2007 |
| WO | WO2009058750 | A1 | 5/2009 |

OTHER PUBLICATIONS

PCT/US2010/038083 International Search Report, Nov. 22, 2010.

PCT/US2010/038083 International Preliminary Report on Patentability, Feb. 9, 2012.

* cited by examiner

PAPERBOARD SECURITY PACKAGES

CROSS REFERENCE TO RELATED APPLICATION

This application claims the benefit of priority under 35 U.S.C. §119(e) of U.S. provisional patent application Ser. No. 61/229,924 filed on Jul. 30, 2009, which is hereby incorporated by reference in its entirety.

BACKGROUND

The present application is directed to paperboard security packages and, more particularly, to reinforcing or theft-prevention features for paperboard security packages.

Manufacturers and retailers of consumer goods, such as pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK packages. Packaging made primarily of paperboard is more sustainable than packaging made from petroleum-based plastics. The paperboard used in such packages may be tear-resistant but these packages still sometimes may be torn resulting in theft or damage to the contents of the package.

Accordingly, there is a need for a stronger security package that has increased tear, tamper and theft resistant features. Although such a package may eventually be breached, if its security features delay opening for a period of time, it will discourage attempts at tampering or theft. Furthermore if the package must be torn to gain access to the contents, such tearing will provide tamper evidence and alert the merchant and consumer to potential product damage. An additional benefit of creating a more secure paperboard based package is the increased sustainability benefit gained by replacing plastic clam shell packages with security enhanced paperboard packages.

SUMMARY

In one aspect, a packaging structure or carton is disclosed which comprises a number of panels of sheet material folded to form the carton, wherein the carton comprises at least one external flap forming a seal, and a reverse partial cut is made into the thickness of the sheet material adjacent an edge of the flap.

In another aspect, a packaging structure or carton is disclosed which comprises a number of panels of sheet material folded to form the carton, wherein the carton comprises at least one external flap forming a closure, and a supplemental flap is sealed to the external flap.

In yet another aspect, a packaging structure or carton is disclosed which comprises a number of panels of sheet material folded to form the carton, wherein the carton comprises at least one external flap forming a closure, and a supplemental flap is sealed to the external flap, wherein a panel portion adjacent the external flap is tucked into the carton before sealing the supplemental flap to the external flap.

Other aspects of the disclosed packaging structures will become apparent from the following description and the accompanying drawings.

DETAILED DESCRIPTION

Figure 1:
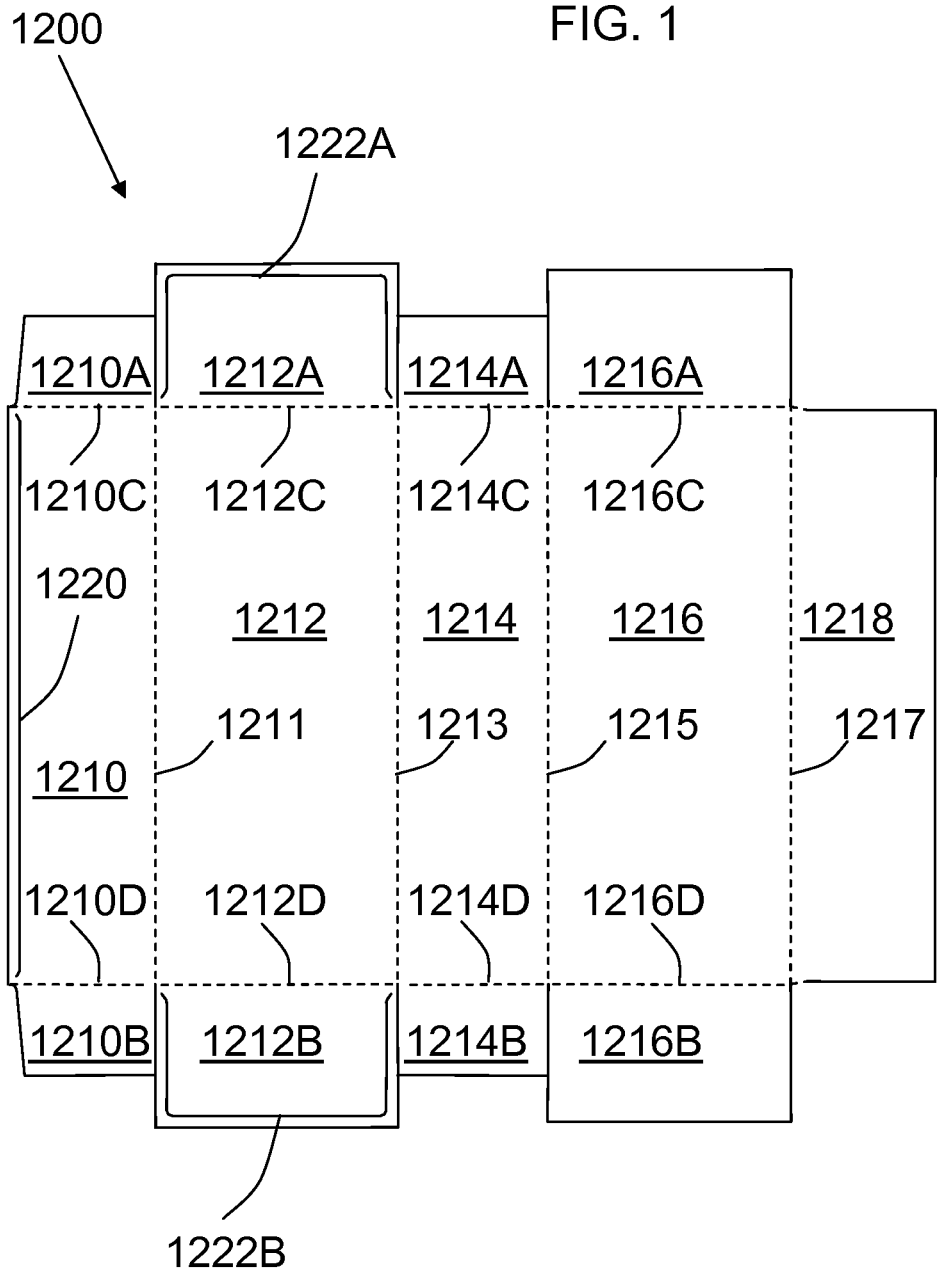
FIG. 1 is a top plan view of a blank for a packaging structure such as a carton.

As various embodiments of the security package are described, reference will be made to FIGS. 1-11. Certain parts of the packages are denoted by reference numerals. Where there is more than one of the same feature, sometimes only one will be denoted by a reference numeral. Typically in these Figures, where a top plan view, or an unfolded perspective view, is shown for a blank of material, solid lines indicate periphery or cuts, and dashed lines indicate crease, score, or fold lines. In perspective views, solid lines typically show edges, while dashed or dotted lines typically show hidden or partially obscured features. Where assembly steps are described, these steps are exemplary and are not to be limiting as to the sequence of operations used to arrive at the final package. Also, directions such as up, down, top, bottom, front, back, left, right, etc. are used for convenience in describing the package and are not meant to be limiting. The designation of certain parts as "panels" or "flaps" is also not meant to be limiting. The packages described here are illustrated as each made from one blank. However, it should be understood that certain blanks may be provided instead as more than one part, while still arriving at the same finished package.

The packaging structures or cartons describe herein may be formed of a sheet material such as paperboard, which may be made of or coated with materials to increase its strength. An example of such a sheet material is tear-resistant NATRALOCK® paperboard made by MeadWestvaco Corporation. Besides being tear resistant, the sheet material may have a heat sealable coating, for example to allow a heat seal to be created between certain portions. Alternately, other forms of adhesive may be used to seal these portions together. It should be noted that the use of tear resistant materials, and/or in more than one layer, help to improve the tamper- and theft-resistance of the package. Typically one surface of the sheet material may have different characteristics than the other surface. For example, the surface of the sheet material that faces outward from a finished package may be particularly smooth and may have a coating such as a clay coating or other surface treatment to provide good printability. The surface of the sheet material that faces inward may, on the other hand, may be provided with a coating, a layer, a treatment or otherwise prepared to provide properties such as one or more of tear-resistance, good gluability, heat sealability, or other desired functional properties.

The packages disclosed herein may be used to enclose either a loose item of merchandise, or an inner carton enclosing merchandise. For example, a manufacturer may have an existing well established carton with a well-recognized brand image, but lacking adequate security. Such a carton may have a premium appearance, for example custom graphics, metallization, embossing, or other premium features. By placing the existing premium carton inside the security package, tamper and theft resistance are provided. Furthermore once the security package is opened (which may destroy the security package) the premium package is still intact. Thus a manufacturer may wish to enclose an existing carton, or simply an item without an additional carton, in any of the security packages described herein.

The following packages and blanks disclosed in this application teach modifications on the standard folding carton packages. The disclosed modifications teach improved security features for a paperboard based package. It is to be understood that a variety of materials may be used to form these packages. However, for sustainability purposes, a paperboard based material may be used and for improved theft deterrence a tear resistant paperboard may be used. The security features described in this application may be used alone or in combination with other described security features.

FIG. 1 shows a plan view of a blank 1200 for forming a security package. The blank may have major panels including back panel 1212, right panel 1214, front panel 1216, left panel 1218, and longitudinal glue flap 1210. These major panels may be hingedly connected by longitudinal fold lines 1211, 1213, 1215, and 1217. At the ends of the blank there may be provided minor panels such as dust flaps 1210A, 1210B, 1214A, and 1214B, as well as end flaps 1216A and 1216B, and end glue flaps 1212A and 1212B. The minor panels may be hingedly connected to the major panels by transverse fold lines 1210C, 1212C, 1214C, 1216C, 1210D, 1212D, 1214D, and 1216D. Within the longitudinal glue flap 1210 and end glue flaps 1212A, 1212B may be provided reverse partial cuts 1220, 1222A, and 1222B, close to the free (that is, non-hingedly connected) periphery of the glue flap. The function of the reverse partial cuts will be explained further below.

As discussed above in regard to the sheet material from which the package is made, blank 1200 may comprise a tear resistant layer on at least one surface. The reverse partial cuts 1220, 1222A, and 1222B are made at least partly through the tear resistant layer. The reverse partial cuts may be continuous or discontinuous. Advantageously the reverse partial cuts are continuous. The reverse partial cuts may be made in the inward, tear resistant, typically non-printed surface.

Figure 2:
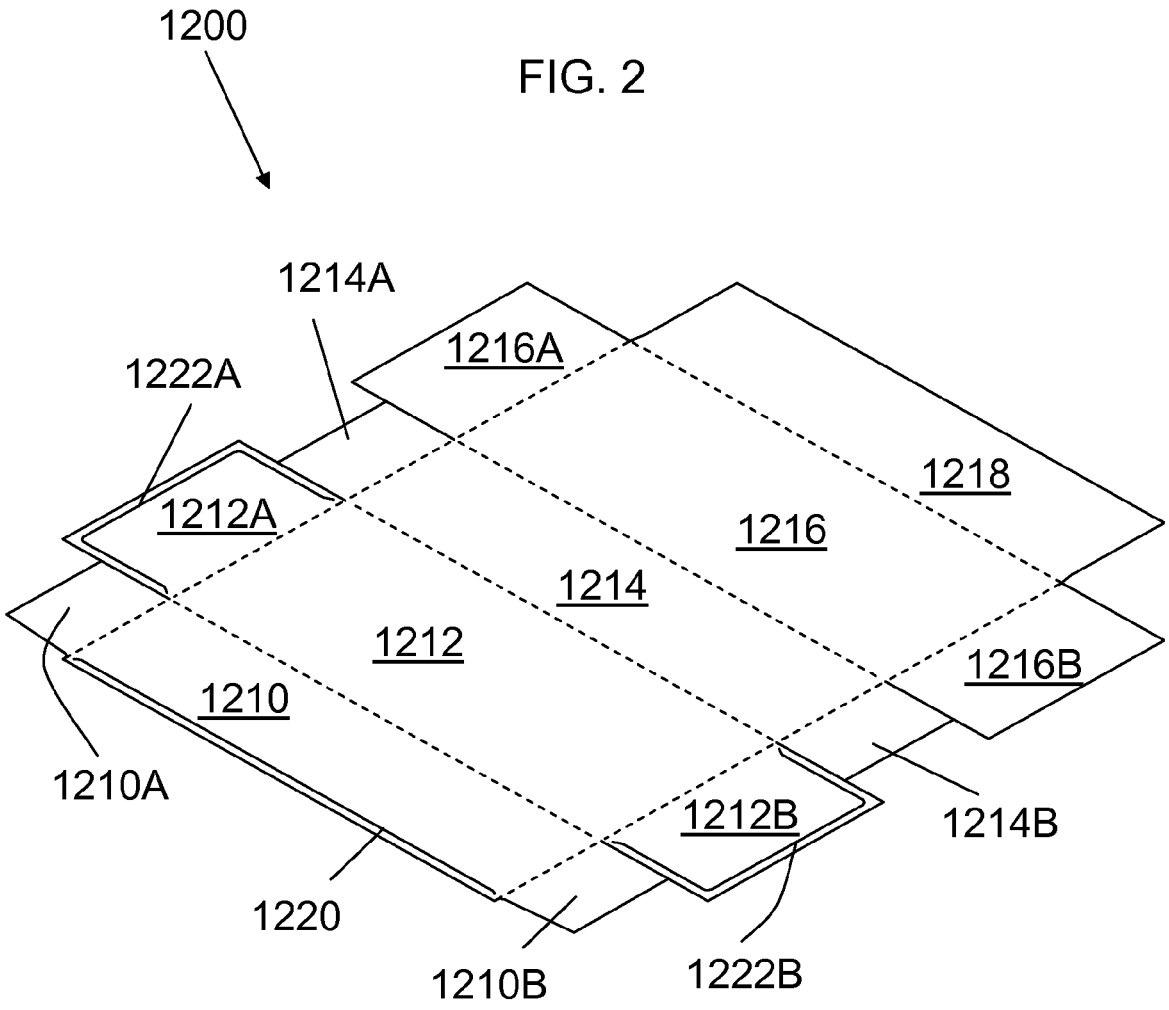
FIG. 2 is a side perspective view of the blank of FIG. 1.

FIG. 2 shows a side perspective view of blank 1200. Not every element of the blank is labeled, as the parts have already been described in FIG. 1.

Figure 3A:
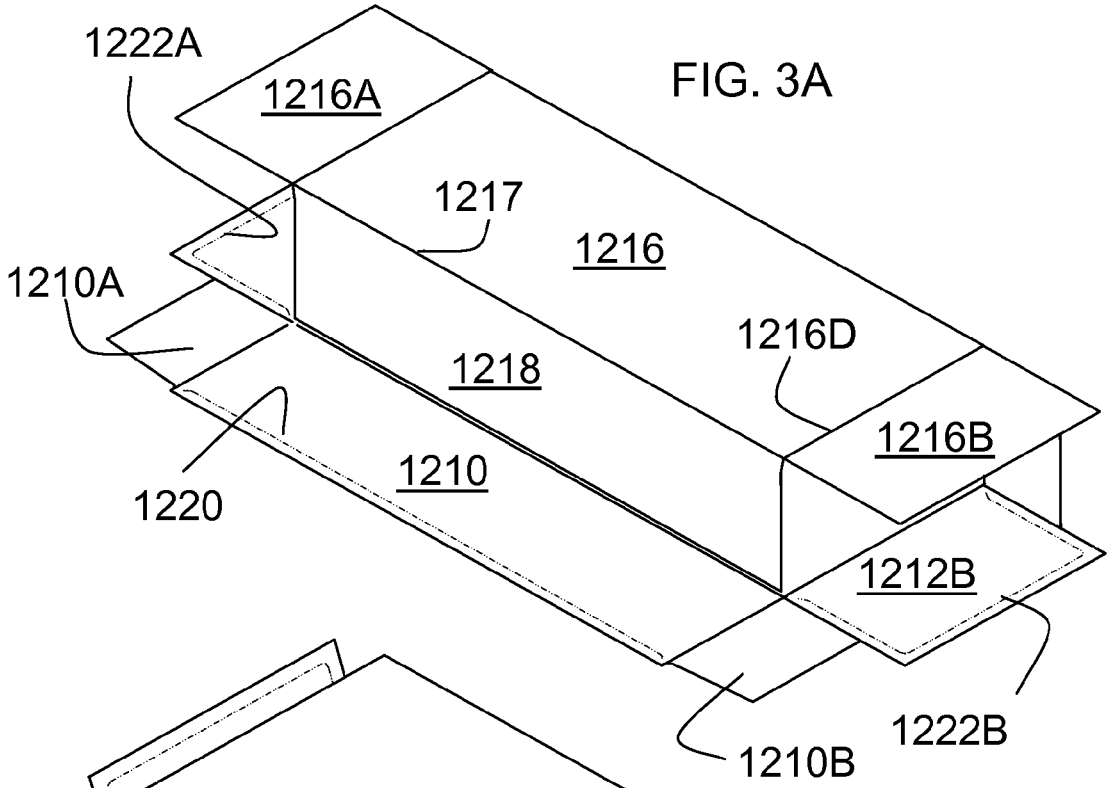
FIGS. 3A and 3B are side perspective views of stages in the assembly of a package made from the blank of FIG. 2.

FIG. 3A shows blank 1200 in a stage of partial assembly, where, relative to FIG. 2, several of the major panels have been hingedly folded relative to one another along the longitudinal fold lines, for example, along longitudinal fold line 1217 between front panel 1216 and left panel 1218. In FIG. 3A, longitudinal glue flap 1210, end flaps 1216A, 1216B and end glue flaps 1212A, 1212B have not yet been folded.

Figure 3B:
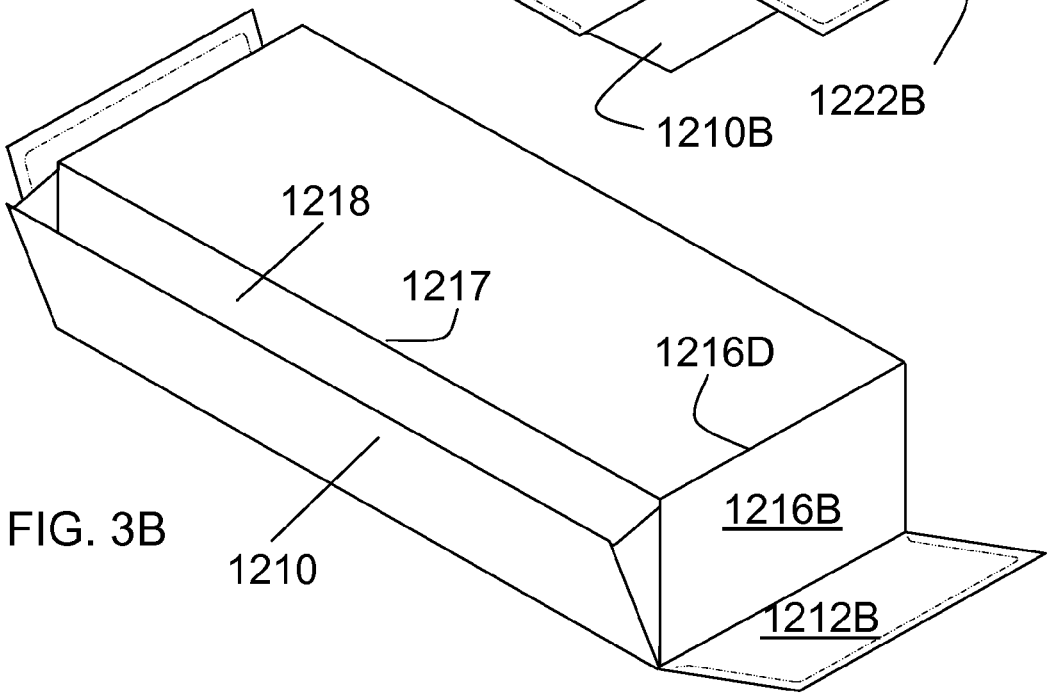

FIG. 3B show longitudinal glue flap 1210 being folded to overlap left panel 1218, to which it may be adhered, for example by gluing or adhesive, or by heat sealing. If heat sealing is used, it may be advantageous to use a backing mandrel within the tubular structure. However, due to the finish carton being closed, it may not be possible to use a mandrel for assistance in gluing every flap. As the longitudinal glue flap 1210 is folded upward, its attached dust flaps 1210A, 1210B are folded into the carton.

Glue or adhesive (or heat sealing) may be applied to the inward surface of longitudinal glue flap 1210 (or to the corresponding surface of left panel 1218, or both surfaces) along the entire mating surfaces, or at least along reverse partial cut 1220. In order to avoid glue or adhesive seeping out of the finished carton which may be unsightly or sticky, glue may be omitted from the narrow outward area of the longitudinal glue flap 1210 between the reverse partial cut 1220 and the adjacent parallel edge of longitudinal glue flap 1210. Advantageously, however, glue may cover up to the reverse partial cut, or even slightly overlap the reverse partial cut, along its entire length. Thus, longitudinal glue flap 1210 may be nearly completely adhered to left panel 1218, except for the very edge of longitudinal glue flap running adjacent and parallel to longitudinal fold line 1217.

The reverse partial cut may be approximately parallel with the adjacent edge of the panel. The reverse partial cut may be approximately one-quarter inch or less from the adjacent edge. However, the distance between the reverse partial cut and the adjacent edge may be adjusted depending upon the gluing method. For example, with a thin, viscous glue the reverse partial cut may be closer than one-quarter inch from the adjacent edge, as a lesser distance may be sufficient to avoid any seepage of glue to or past the edge. Likewise if heat sealing is used, a relatively small separation may be used if the heat seal material does not exhibit any appreciable creep or seepage toward the edge. However, if a liquid adhesive or hot melt glue is used that may more readily migrate toward the adjacent edge, then the distance of the reverse partial cut from the adjacent edge may be suitably increased as needed to avoid any seepage of adhesive out of the edge.

As shown in FIG. 3B, end flap 1216A (not shown) and 1216B may be folded inward, for example along transverse fold line 1216D between front panel 1216 and end flap 1216B. Once these end flaps are folded inward, end glue flaps 1212A (not shown) and 1212B may be fold over the end flaps, a process which is shown in progress in FIG. 3B. Glue or adhesive (or heat sealing) may be applied to the inward surface of end glue flap 1212B (or to the corresponding mating surface of end flap 1216B, or both surfaces) along the entire mating surfaces, or at least along reverse partial cut 1222B. In order to avoid glue or adhesive seeping out of the finished carton which may be unsightly or sticky, glue may be omitted from the narrow outward area of the end glue flap 1212B between the reverse partial cut 1222B and the adjacent parallel edge of end glue flap 1212B. Advantageously, however, glue may cover up to the reverse partial cut, or even slightly overlap the reverse partial cut, along its entire course. Thus, end glue flap 1212B may be nearly completely adhered to end flap 1216B, except for the peripheral unhinged edges of end glue flap 1212B, running adjacent and parallel along the carton end left adjacent to left panel 1218 and longitudinal glue flap 1210, along the carton end front edge adjacent to front panel 1216, and along the carton end right edge adjacent to right panel 1214 (not shown in FIG. 3B).

Figure 4A:
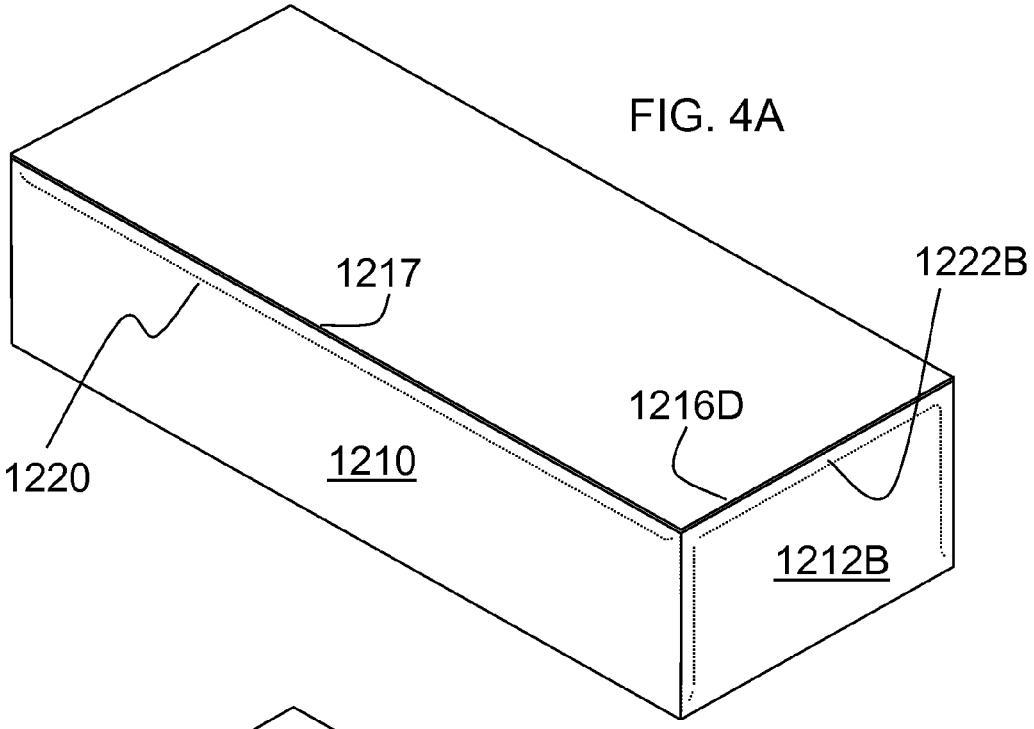
FIG. 4A is a side perspective view of a completed package made from the blank of FIG. 2.

FIG. 4A shows a completed carton. It will be noted that the longitudinal glue flap 1210 may have a "clean edge" along longitudinal fold line 1217, that is, without any glue or adhesive seeping out along this line. Also, end glue flap 1212B may have a "clean edge" along transverse fold line 1216D, that is, without any glue or adhesive seeping out along this unhinged edge, nor along its unhinged edges adjacent to longitudinal glue flap 1210 or adjacent to right panel 1214 (not shown). These "clean edges" are attractive. However, they may provide an edge from which a thief may initiate a tearing or peeling action in which to attempt breaking into the carton.

Figure 4B:
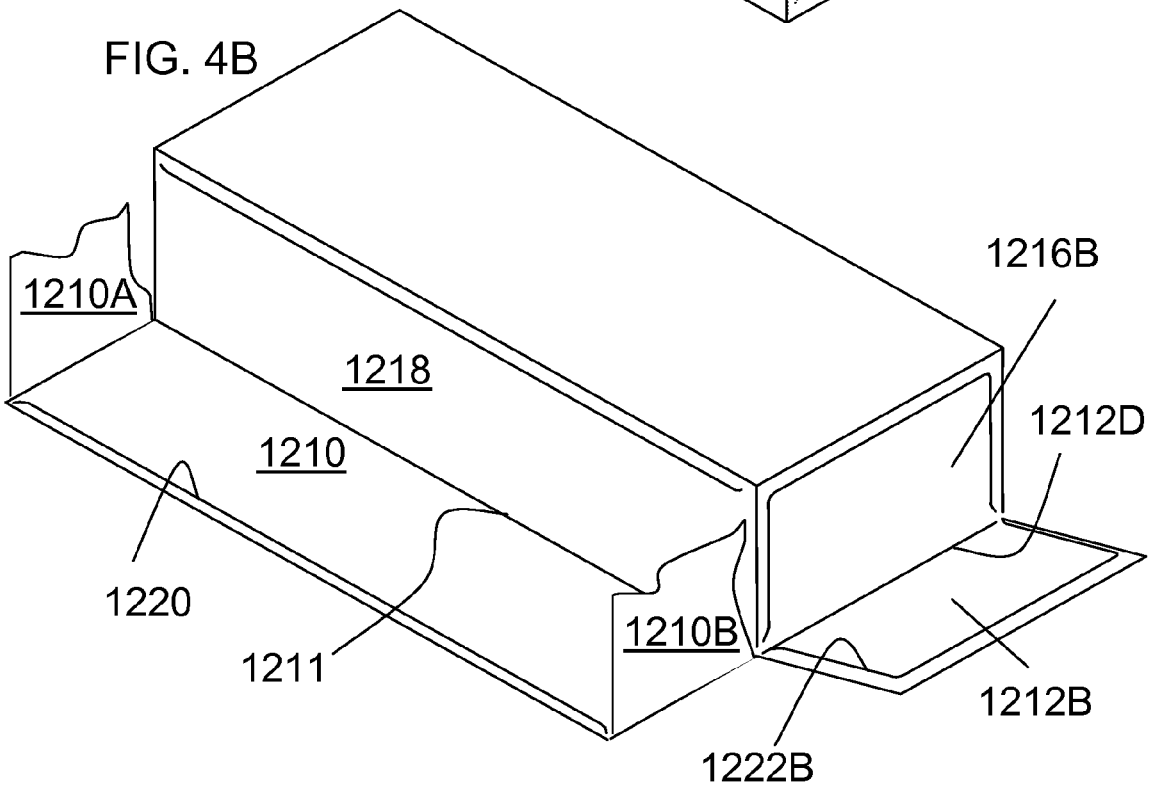
FIG. 4B is a side perspective view of a the package of FIG. 4A, illustrating the effect of certain security features.

FIG. 4B shows what may happen if tearing or peeling is initiated from the "clean edges." For example, if a thief attacks end glue flap 1212B by attempting to peel its free edge away from transverse fold line 1216D, the sheet material of end glue flap 1212B may be displaced away from the body of the carton. However, even though the "clean edge" of end glue flap 1212B may be unadhered, when a peeling or tearing motion reaches the reverse partial cut 1222B, the adhesive will resist further tearing or peeling. The end glue flap 1212B may then delaminate starting approximately at the reverse partial cut 1222B, as shown in FIG. 4B where an example delaminated area is shown by shading. Although the "loose" outer portion of end glue flap 1212B is pulled away, most of the inward surface comprising the tear resistant layer is still firmly adhered to the carton and still provides a strong barrier against opening the carton, even along the transverse fold line 1212D.

Likewise, if a thief attacks longitudinal glue flap 1210 by attempting to peel its free edge away from longitudinal fold line 1217, the sheet material of longitudinal glue flap 1210 may be displaced away from the body of the carton. However, even though the "clean edge" of longitudinal glue flap 1210 may be unadhered, when a peeling or tearing motion reaches the reverse partial cut 1220, the adhesive will resist further tearing or peeling. The longitudinal glue flap 1210 may then delaminate starting approximately at the reverse partial cut 1220, as shown in FIG. 4B where an example delaminated area is shown by shading. Although the "loose" outer portion of longitudinal glue flap 1210 is pulled away, most of the inward surface comprising the tear resistant layer is still firmly adhered to the carton and still provides a strong barrier against opening the carton, even along longitudinal fold line 1211. Besides the glue itself firmly holding the longitudinal glue flap 1210 to the carton, the dust flaps 1210A, 1210B attached thereto are, in the intact carton, trapped with the closed ends, which should make it difficult to tear open the longitudinal flap.

Figure 5:
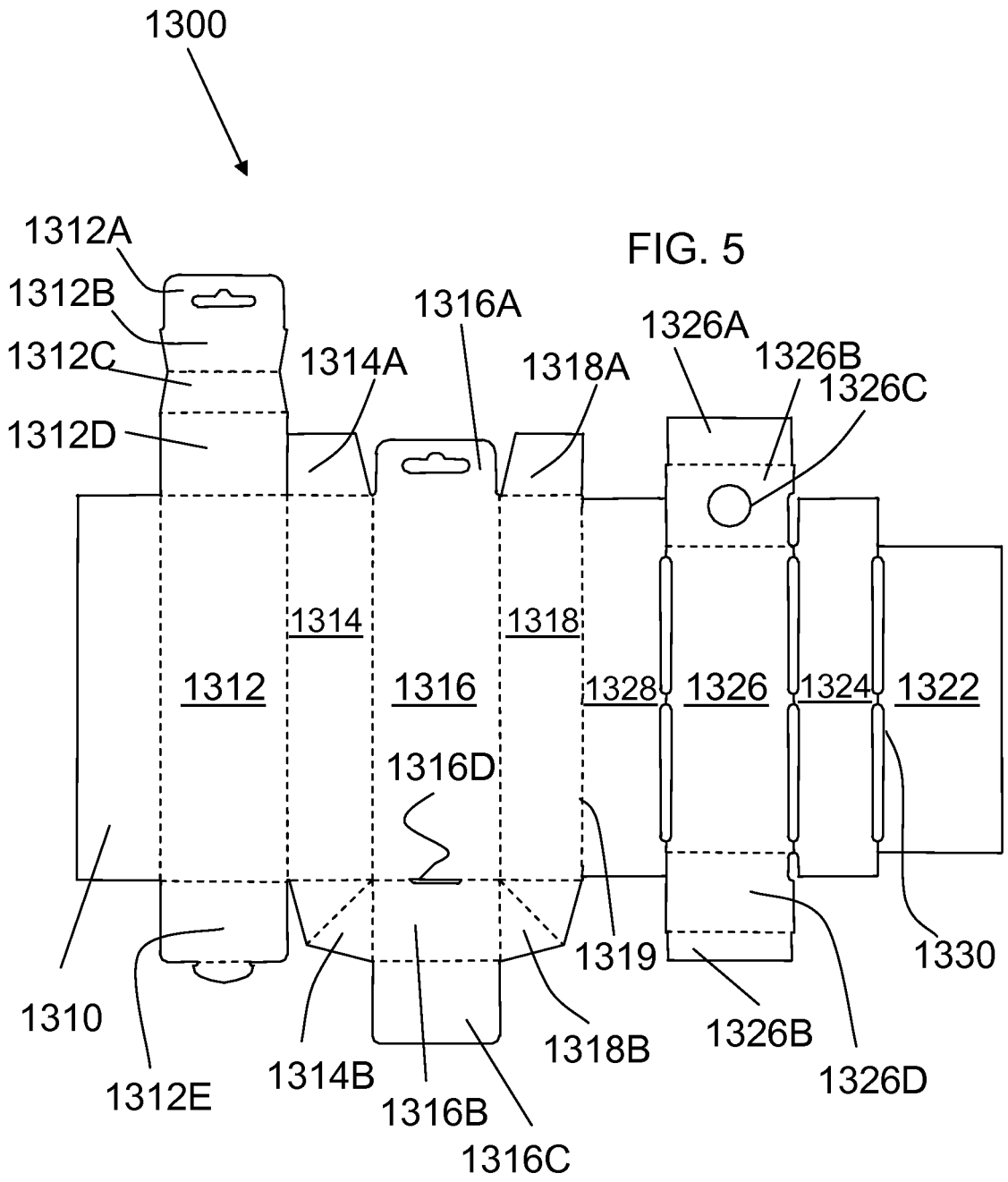
FIG. 5 is a top plan view of a blank for a another packaging structure.

FIG. 5 shows a plan view of another blank 1300 for forming another security package. The blank may have major panels including front panel 1312, left panel 1314, back panel 1316, right panel 1318, and longitudinal glue flap 1310. These major panels may be hingedly connected by longitudinal fold lines (not numbered). At the ends of the blank there may be provided minor panels such as dust flaps 1314A, 1318A, gusset panels 1314B, 1318B, end flaps 1312D and 1316B, and end seal panels 1312A, 1316A and 1312E, 1316C. The minor panels may be hingedly connected to the major panels or to one another by transverse fold lines (not numbered).

Blank 1300 is provided with additional panels to form an inner layer within the carton structure Inner major panels include right inner panel 1328 (hingedly connected to right panel 1318 through fold line 1319), back inner panel 1326, left inner panel 1324 and front inner panel 1322. The inner major panels may be hingedly connected to one another for example along relief slots 1330 where some panel material is removed so that the carton assembly may be folded into a tubular structure without buckling out of the desired shape. Additional panels or features will be described below.

Blank 1300 may comprise a tear resistant layer on at least one surface. Blank 1300 may also comprise a heat sealable layer on at least one surface. For the example shown, it will be assumed that the tear resistant layer is on the upward facing surface of blank 1300, as shown in FIGS. 5 and 6.

Figure 6:
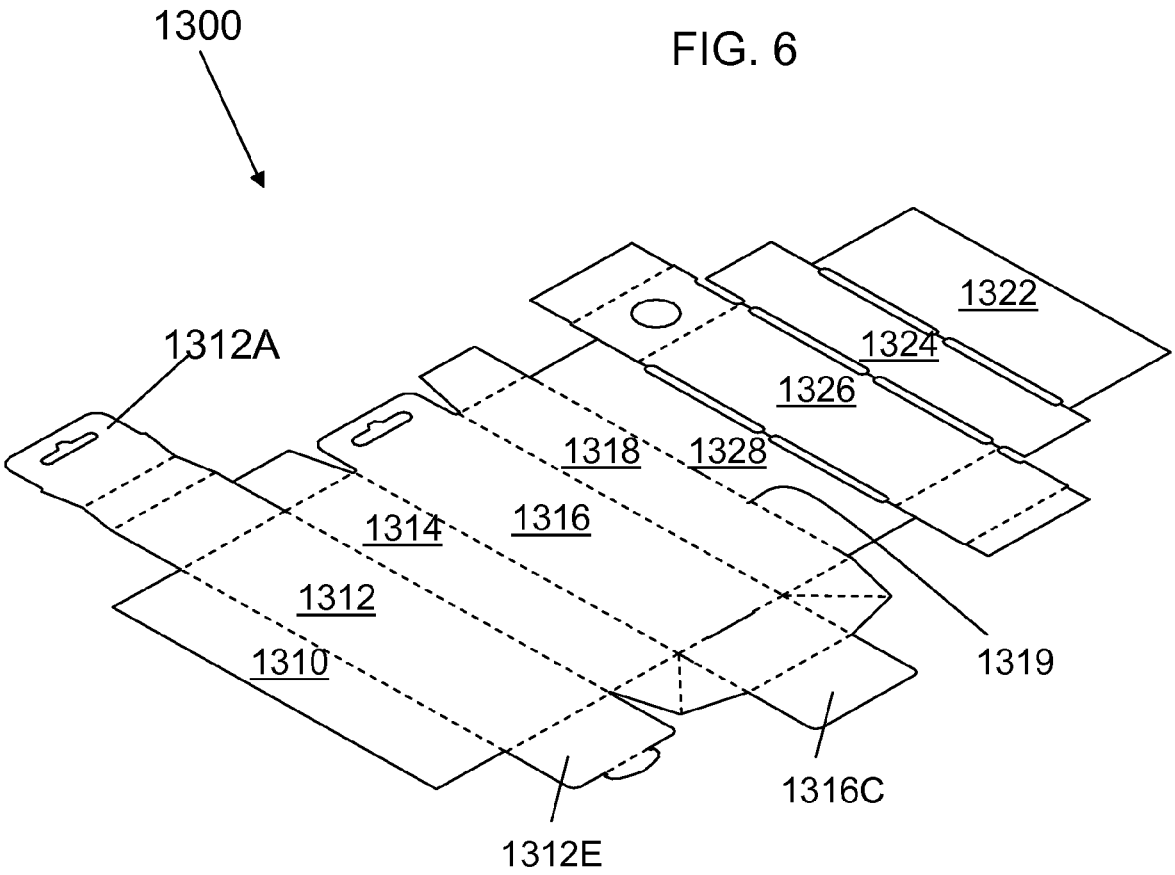
FIG. 6 is a side perspective view of the blank of FIG. 5.

FIG. 6 shows a side perspective view of blank 1300. Not every element of the blank is labeled, as the parts have already been described in FIG. 5.

Figure 7:
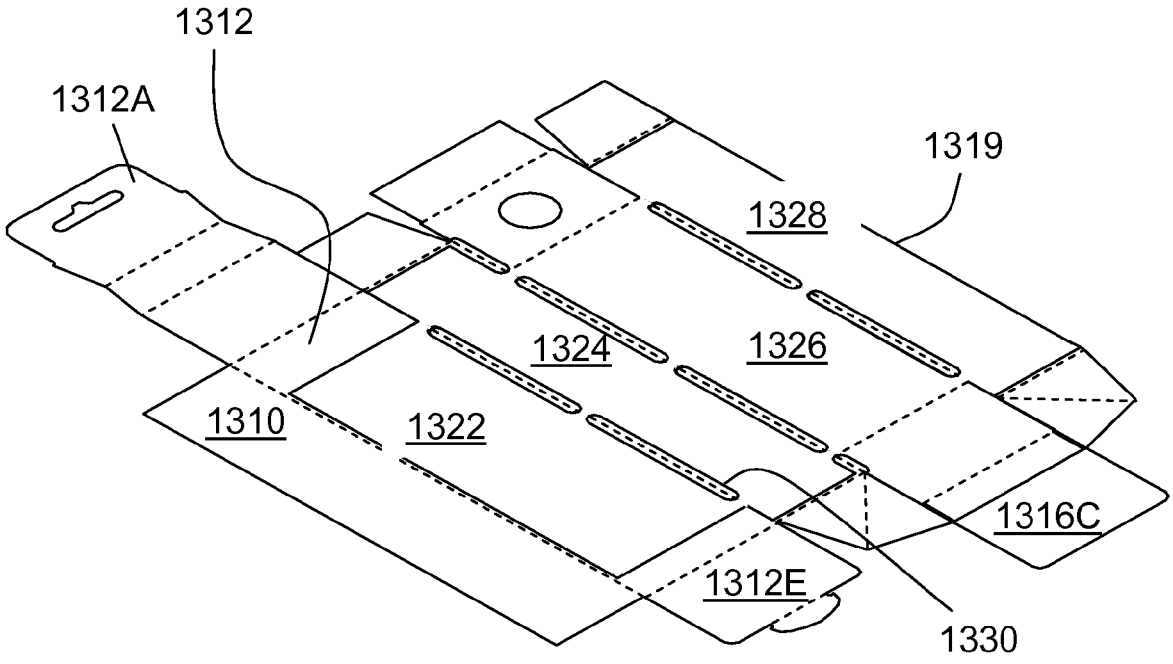
FIG. 7 is a side perspective view of the blank of FIG. 5, with an inner layer folded inward onto an outer layer.

FIG. 7 shows a perspective view similar to FIG. 6, except that the inner panels (shown shaded in FIG. 7) are folded over their corresponding (outer) panels. Having folded the inner panels over along fold line 1319, the panels now overlap, for example front inner panel 1322 overlaps front panel 1312. The inner panels may be adhered to the outer panels now, for example by heat sealing, glue or adhesive. Relief slots 1330 as provided between the inner panels allow the blank to be folded into a tubular structure without buckling, even if the two layers as shown in FIG. 7 are adhered together.

Figure 8:
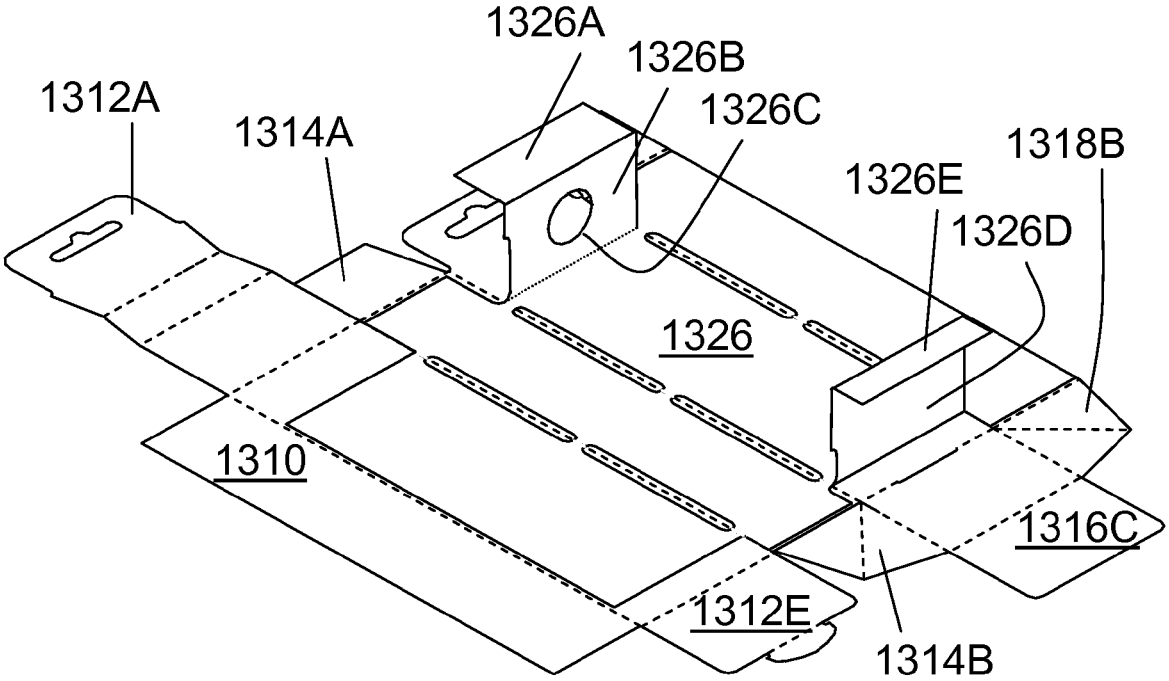
FIG. 8 is a side perspective view of the blank of FIG. 7, showing certain internal support structures.

FIG. 8 shows how portions of the inner layer may be used to form internal structures within the carton. For example, lower brace panel 1326D and lower brace flap 1326E may be folded upward from back inner panel 1326 to form a lower brace or false floor within the carton. Upper brace panel 1326B and upper brace flap 1326A may be folded upward from back inner panel 1326 to form an upper brace or stabilizer, for example having a hole 1326C to accommodate the neck of a bottle.

Figure 9:
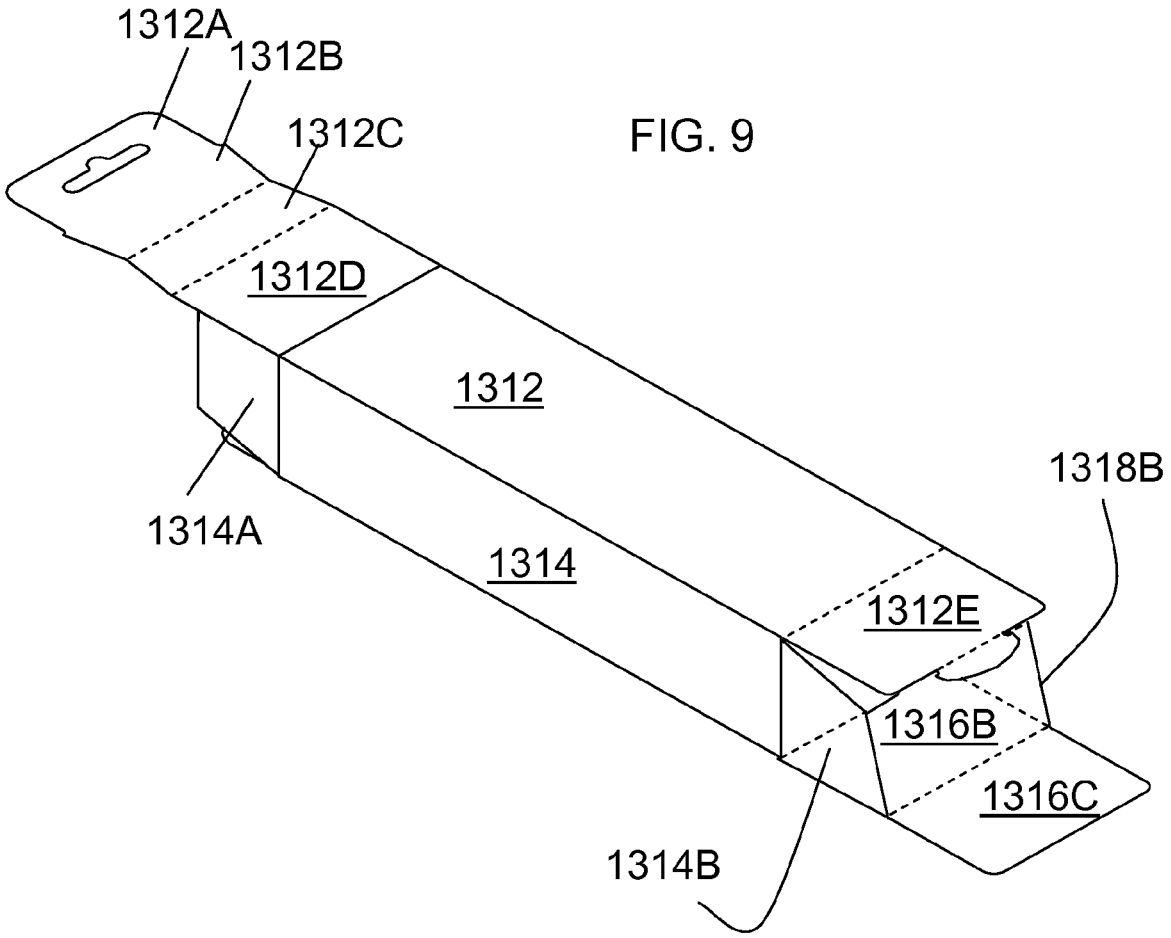
FIG. 9 is a side perspective view of the blank of FIG. 7, having been folded into a tubular form in a stage of being assembled into a carton.

FIG. 9 shows a step in the assembly of the blank 1300 in to a carton, where the blank has been folded into a tubular form. Major panels shown here include front panel 1312 and left panel 1314.

Figure 10A:
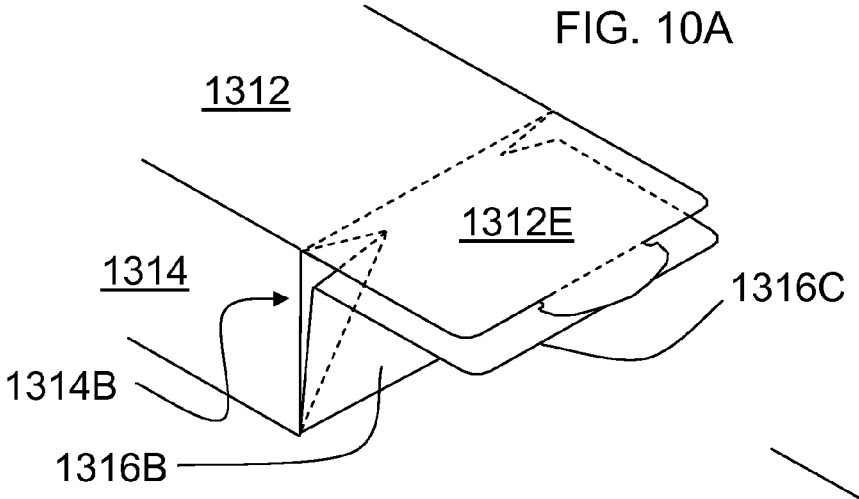
FIGS. 10A-10C are end perspective views of a first end of the tubular form of FIG. 9, showing features of a security closure.
Figure 10B:
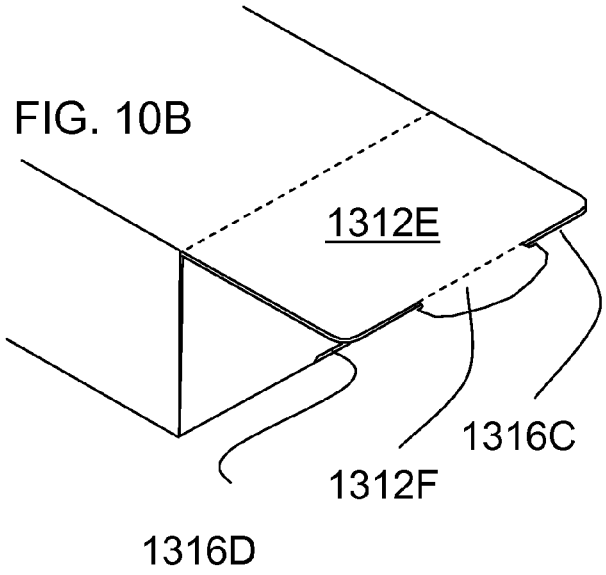
Figure 10C:
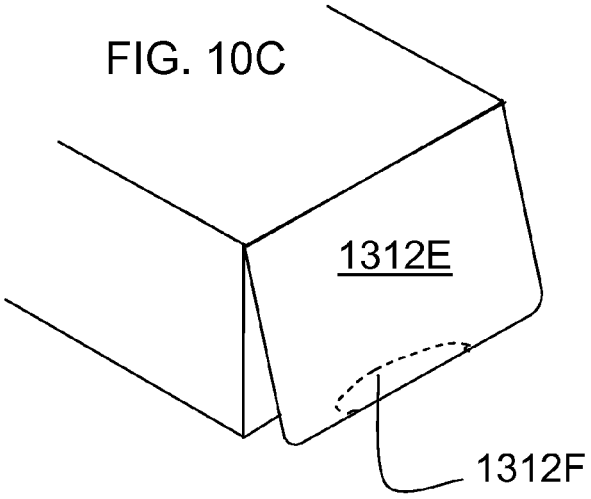

FIGS. 10A-10C show the closure of the first or lower end of the carton in more detail. As shown in FIG. 10A, gusset panels 1314B may first be folded inward as end flap 1316B is also folded inward. The gusset panels 1314B provide a strong structure along their outward edge. As shown in FIG. 10B, when this folding step is complete, end flap 1316B comes into facing contact with end seal panel 1312E, with the heat sealable surfaces in contact. Pressure and heat may then be applied (or other glue or adhesive used) to join end flap 1316B and end seal panel 1312E securely together. The end of the carton is now securely closed. The composite flap (end seal panel 1316B joined with end seal panel 1312E) may then be folded onto the end of the carton, and held there by placing arrow lock 1312F into lock slot 1316D, as shown in FIGS. 10B and 10C.

Figures 11A, 11B:
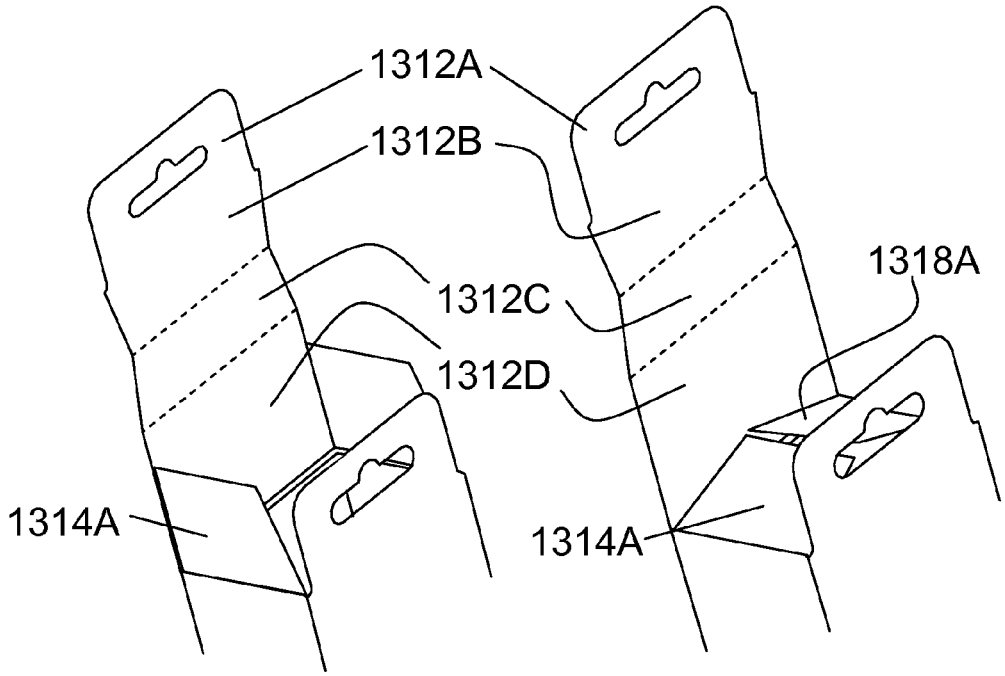
FIGS. 11A-11D are end perspective views of a second end of the tubular form of FIG. 9, showing features of another security closure.

FIGS. 11A-11D show the closure of the second or upper of the carton in more detail. FIG. 11A shows the open upper end, including dust flaps 1314A, 1318A, and end flap 1312D which are hingedly attached to the left panel 1314, right panel 1318, and front panel 1312 respectively. Also shown, hingedly attached to end flap 1312D, are infold panel 1312C, tuck-in panel 1312B, and end seal panel 1312A.

FIG. 11B shows dust flaps 1314A and 1318A folded inward over the open end.

Figures 11C, 11D:
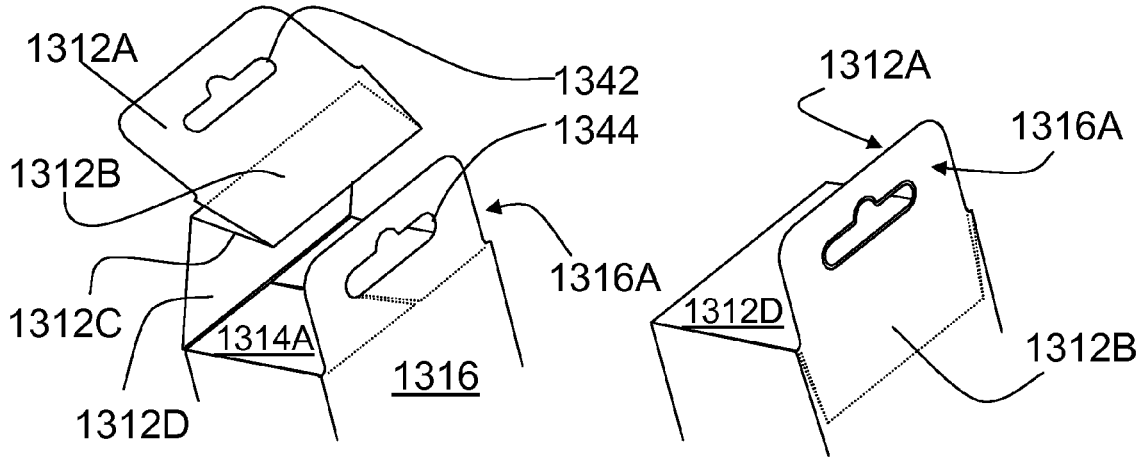

FIG. 11C shows end flap 1312D being folded inward upon the end of the carton. Also shown are infold panel 1312C with tuck-in panel 1312B, positioned ready to tuck into the carton.

FIG. 11D shows infold panel 1312C and tuck-in panel 1312B having been tucked into the carton (as shown by dotted line representing tuck-in panel 1312B. This brings end seal panel 1312A into facing contact with end seal panel 1316A, with the heat sealable surface in contact. Pressure and heat may then be applied (or other glue or adhesive used) to securely join together end seal panels 1312A and 1316A. The composite (two layer) structure of end seal panels 1312A and 1316A is strong and the placement of the infold panel 1312C and tuck-in panel 1312B lends additional strength to the structure, helping prevent opening of the upper end of the carton. A hang hole may be provided, for example by providing apertures 1342, 1344 in the seal flaps.

The exemplary folds, creases, or scores shown here may be generally straight lines, but the folds, creases or scores may also be curved. The shape of the fold lines may be determined by manufacturing preferences depending upon the product the package is designed to contain. In some instances certain fold lines may be omitted and portions of the blank during assembly may be formed without using fold lines. The packages shown here may have generally flat surfaces, but packages may be designed so that at least some surfaces may be nonplanar or curved.

The packages may, for example, be formed of a tear resistant sheet material such as NATRALOCK® paperboard made by MeadWestvaco Corporation.

The packages described herein may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

The packages may be shipped flat and erected when the product is filled or may be shipped partly formed such that final sealing only needs to be done to certain portions of the package after filling. It is to be understood that various sealing methods may be utilized depending upon manufacturing preferences, and that the disclosed packages may exhibit increased tear resistance with whatever type of sealing is used; e.g. heat sealing, hot melt glue, or other adhesives.

Portions of the packages may be made of one, two, or more layers of material. It is to be understood that additional layers of material may be used based on manufacturing preferences. Portions of certain panels may be folded over or around the portions of other panels, creating multiple layers of material. Folds between panels or walls may be reinforced by inward gussets or external gussets.

Those skilled in the art will appreciate that the disclosed packaging structures may provide a theft deterrent function at least for a few moments, while providing legitimate consumers with packages easy to open in a reasonably short time, for example using a pair of scissors and reducing the risk of injury as the scissors are less likely to slip on the NATRALOCK® or paperboard like material than on a plastic blister pack.

It is to be understood that although various aspects of the disclosed packaging structures have been shown and described, modifications may occur to those skilled in the art upon reading the specification.

The invention claimed is:

1. A packaging structure comprising:

a plurality of panels hingedly attached to one another and comprising a first panel and a second panel with at least a third panel therebetween;

a glue flap having a first edge hingedly attached to said second panel, and having a second edge opposite from the first edge, the second edge not directly hingedly attached to any of said plurality of panels;

said glue flap overlapping said first panel such that the outward-facing surface of said glue flap forms an outer surface of the packaging structure, and the inward-facing surface of said glue flap is in facing relationship with the first panel and sealed thereto; and a reverse partial cut formed in the inward-facing surface of said glue flap;

wherein said panels and said glue flap comprise a tear-resistant layer;

wherein said reverse partial cut penetrates said tear-resistant layer; and wherein the reverse partial cut is located approximately parallel to said second edge and within about ¼ inch or less of said second edge.

2. The packaging structure of claim 1, wherein said panels and said glue flap comprise a heat-sealable layer.

3. The packaging structure of claim 1, wherein a peeling or tearing force applied to second edge results in a delamination of said glue flap between said reverse partial cut and said first edge.

4. The packaging structure of claim 3, wherein after said delamination of the glue flap, the tear-resistant layer remains adhered to the first panel between the reverse partial cut and the first edge.

5. The packaging structure of claim 1, the glue flap further comprising a free third edge extending from the first edge to the second edge, wherein a reverse partial cut is located approximately parallel to said third edge and within about ¼ inch or less of said third edge.

6. The packaging structure of claim 1, the glue flap further comprising a free third edge extending from the first edge to the second edge, and a free fourth edge opposite from the free third edge and extending from the first edge to the second edge, one or more reverse partial cuts are formed approximately parallel to and within about ¼ inch or less of each of the second, third, and fourth edges.

7. A packaging structure comprising:

a plurality of panels at least some of which are hingedly attached to one another, wherein said plurality of panels are formed into a tubular structure, the tubular structure comprising a first end;

a second end opposed to the first end;

a first panel terminating at said first end as a first seal flap;

a second panel terminating at said first end, and hingedly attached to an end flap at said first end, the end flap in turn hingedly attached to a second seal flap, where the second panel is on an opposite surface of the packaging surface relative to said first panel, wherein the first and second panels are parallel;

wherein said end flap is folded across the tubular structure at the first end, and the first and second seal flaps are brought into facing contact with one another, and the first and second seal flaps are sealed together;

wherein said end flap, said first seal flap, and said second seal flap are all on the outside of the packaging structure, between the first and second ends, a tubular structure comprising a plurality of panels hingedly attached to one another and comprising a third panel and a fourth panel with at least a fifth panel therebetween;

a glue flap having a first edge hingedly attached to said fourth panel, and having a second edge opposite from the first edge, the second edge not directly hingedly attached to any of said plurality of panels;

said glue flap overlapping said third panel such that the outward-facing surface of said glue flap forms an outer surface of the packaging structure and the inward-facing surface of said glue flap is in facing relationship with the third panel and sealed thereto; and a reverse partial cut formed in the inward-facing surface of said glue flap.

8. The packaging structure of claim 7, wherein said panels comprise a tear-resistant layer.

9. The packaging structure of claim 7, wherein said panels comprise a heat-sealable layer.

10. The packaging structure of claim 9, wherein said first and second seal flaps are sealed together by heat sealing of their heat-sealable layers.

11. The packaging structure of claim 7, wherein after sealing together the first and second seal flaps, an arrow lock attached to one of said first and second seal flaps is placed into a slot on said packaging structure.

12. A packaging structure comprising:

a plurality of panels at least some of which are hingedly attached to one another, wherein said plurality of panels are formed into a tubular structure, the tubular structure comprising a first end;

a first panel terminating at the first end, and hingedly connected to a first seal flap at said first end;

a second panel terminating at said first end, and hingedly attached to an end flap at said first end, the end flap in turn hingedly attached to an infold panel, the infold panel in turn hingedly attached to a second seal flap, the second panel being on an opposite surface of the packaging structure relative to said first panel, wherein the first and second major panels are parallel;

wherein the end flap is folded across the tubular structure at the first end, the infold panel is tucked inside the tubular structure, and the first and second seal flaps are brought into facing contact with one another and sealed together;

wherein the end flap, first seal flap, and second seal flap are all on the outside of the packaging structure.

* * * * *